US005333909A

United States Patent [19]

Hedge, Jr.

[11] Patent Number: 5,333,909

[45] Date of Patent: Aug. 2, 1994

[54] PROMOTIONAL ADVERTISING BROCHURE INCLUDING REUSABLE ENVELOPE DEVICE

[76] Inventor: J. Richard Hedge, Jr., 7887 N. La Cholla Blvd. #2155, Tucson, Ariz. 85741

[21] Appl. No.: 28,521

[22] Filed: Mar. 9, 1993

Related U.S. Application Data

[60] Division of Ser. No. 746,072, Aug. 9, 1991, abandoned, which is a continuation-in-part of Ser. No. 488,470, Feb. 26, 1990, abandoned, which is a continuation-in-part of Ser. No. 376,639, Jul. 6, 1989, abandoned.

[51] Int. Cl.[5] ..... B42D 15/00

[52] U.S. Cl. ..... 283/56; 40/124.1; 281/15.1

[58] Field of Search ..... 40/124.1; 281/15.1, 281/31; 283/56, 62

[56] References Cited

U.S. PATENT DOCUMENTS

| | | | |
|---|---|---|---|
| 735,486 | 8/1903 | Fels | 40/124.1 X |
| 2,279,164 | 4/1942 | Gettleman | 283/56 |
| 3,460,744 | 8/1969 | Turkenkopf | 283/56 |
| 3,922,743 | 12/1975 | Schuler et al. | 412/24 |
| 3,970,332 | 7/1976 | Alford, Jr. | 283/56 X |
| 4,051,996 | 10/1977 | Ross et al. | 281/31 X |
| 4,305,605 | 12/1981 | Vine | 283/56 |
| 4,516,793 | 5/1985 | Kiyokane | 282/25 |
| 4,520,958 | 6/1985 | Jones et al. | 283/56 |
| 4,566,720 | 1/1986 | Goldmann et al. | 282/25 |
| 4,592,573 | 6/1986 | Crowell | 283/56 |
| 4,614,364 | 9/1986 | Bortner | 283/45 |
| 4,616,852 | 10/1986 | Cash | 283/56 |
| 4,621,729 | 11/1986 | Jackson | 281/31 X |
| 4,624,482 | 11/1986 | Cassells | 283/62 |
| 4,685,699 | 8/1987 | Hirasawa | 283/56 |

FOREIGN PATENT DOCUMENTS

| | | | |
|---|---|---|---|
| 63241 | 11/1912 | Switzerland | 283/56 |

*Primary Examiner*—Paul A. Bell

[57] ABSTRACT

A combined advertising brochure and separable reusable envelope device formed from a rectangular sheet being portioned and folded through the application of grouped parallel scorelines (242) and/or perforation lines (221). Additional format ad space is provided amidst given vertex fold points through the mounting of preassembled leaflet configurations (261A), either of which are attached to the brochure via a release adhesive (301). The further formation of a separable reusable envelope, and accompanying ad contents (40), becomes incorporated on at least one end of the brochure embodiment. Furthermore, the free standing aftermarket envelope portion becomes closed through the engagement of the tuck-in tongue enablements (381A and 381B). Likewise, the aftermarket envelope is enhanced with a categorical title strip (281) located about the exposed inside back panel of the envelope. Moreover, the aftermarket envelope portionment is further enhanced via the (landscape) pictorial ad field (421) which spans the aftermarket envelope's front side.

10 Claims, 13 Drawing Sheets

PROMOTIONAL ADVERTISING BROCHURE INCLUDING REUSABLE ENVELOPE DEVICE

This application is a division of Ser. No. 07/746,072, filed Aug. 9, 1991, now abandoned, which was a continuation-in-part of Ser. No. 07/488,470, filed Feb. 26, 1990, now abandoned, which was a continuation-in-part of Ser. Nos. 07/376,639, filed Jul. 6, 1989, now abandoned.

BACKGROUND OF THE INVENTION

The present invention relates generally to an advertising device bearing a plurality of coupons or the like promotions and, more particularly to a brochure bearing promotional advertising and delivering coupons in a more spontaneously organizing fashion through means of reusable envelopes and releasable leaflets which are not substantially in view until further investigation occurs.

Although advertisements are not entirely exclusive to the "coupon" type, much of the device's attributes are sought for this purpose. Typically, co-operative advertising vehicles promoting coupons via standard ad copy, pop-up ads, or scratch off game promotions to any significance are deployed through means of magazine supplements, free standing inserts, roll off the press newsprints, or direct mail applications.

These modes, while effectively proliferating mind boggling numbers of coupons, offer dismal redemption results in relation to their given proliferated numbers thereby limiting their cost effectiveness and likewise attractiveness. As presently illustrated in U.S. Pat. No. 4,614,364 to Bortner, "Free Standing Insert With Coupon Flap," Bortner's more conventional format of using extremely high volume Sunday F.S.I.'s adds one of the most singly significant sources of coupon promotions into the marketplace.

Furthermore, Bortner and other's accrued F.S.I. volume and methods for coupon proliferation presently enjoy tremendous appeal in certain consumer circles possessing the required time and fortitude to clip coupons and organize themselves. However, further improvement in redemption results amidst the industries present means of deployment alone, certainly has no future. Moreover, the aforementioned dismal redemption results are directly accrued through just these very formats and methods of deployment mentioned above, whereby leaving behind the overwhelming majority of otherwise redeemable coupons for trash pick-up.

In further reference to the promotional medium of couponing; U.S. Pat. No. 4,520,958 to Jones et al., "Multi-Compartment Envelope For Coupon Nesting," Jones seemingly begins to establish the basis for a more refreshing approach to the common issues facing couponing (i.e. cost effectiveness and packaging) as an effective medium. And yet, this approach is immediately countered via Jones' own awkward, even clumsy "pressure sleeve" envelope certainly explain the invention's absence from the larger stage of design format. Furthermore, Jones' design deficiency could most certainly explain the invention's absence from the larger stage of promotional events.

In summation, the reason for the less than desirable redemption returns is clear. The present deployment activities of promotional advertising events are overwhelmingly predisposed to the operational premise of using exorbitant saturation methods alone, and thereby are remiss in their identification of, and adjustment to the greater issues facing couponing as an effective medium to date. These issues being, sustained market penetration (on a per drop basis), whereby enhancing the coupon's access to a given consumer's purchase cycle; and requisitely, the most imperative issue being that of attaining a sustainably heightened redemption performance.

In light of this, the major shortcoming of the prevailing deployment vehicles for high volume coupon proliferation is that they are entirely lacking any residual instrument in service past their initial drop dates, thereby leaving the benefits of successful coupon redemption to only a disciplined and organized minority of consumers.

Therefore, the present invention's formative approach is to envelop an attractive, intriguing convenience while positioning the recipient of the advertising brochure and its contents (structural copy inclusive) into a discipline of spontaneous organization through the device's systematic prescription.

SUMMARY OF THE INVENTION

Accordingly, several objects and advantages of the invention are as previously mentioned. The characteristics of intrigue and convenience, brought about by means of the invention's systematic and formative approach, enables both the recipient and sponsorship alike to prosper from the invention's insightful and spontaneous organizational structure.

Furthermore, it is the primary objective of the present invention to provide a viable new application to the co-operative activities engaging the high volume promotional medium of couponing throughout the marketplace.

It is another objective of the invention to provide a production format which inturn can be economically produced through the utilization of ever modernizing computer graphics capabilities and high speed Web offset or the like printing and production equipment.

It is still another objective of the invention to provide a device adapted to contain on any or all surfaces, printed matter such as advertising and structural copy, business reply mail, and indicia.

It is yet another objective to provide a preassembled releasable leaflet format means as a variation for engaging the expanded supplementation of a frequently changing course of promotional advertising attractions (i.e. expanded promotional ads and/or games) while observing the invention's general format basis.

It is yet still another objective to provide a preassembled releasable leaflet format means as a variation in order to fulfill the structural basis necessary for servicing a given sponsor's pop-up type advertisement (not illustrated).

It is yet still another objective to provide separable aftermarket envelopes for the purpose of stimulating the spontaneous organization of the recipient and thereby responding to this need which is presently unfulfilled by the current high volume consumer promotions marketplace.

It is still even another objective to provide an innovative ability to further organize the recipient by means of the invention's separable aftermarket envelope(s) which shall be structurally enhanced with a name brand or generic title classification located about the length of the envelope's exposed inside back panel (which may include color coding), whereby establishing the opportunity for the recipient to accumulate a complete organizational aftermarket filing system.

It is still yet another objective to provide a variety of reusable aftermarket envelopes with special pictorial field(s) for illustrating a given sponsor's name brand product(s) or service(s) wherein the envelope's field of illustration aligns in a (landscape) fashion, in relation to its neighboring generally portrait ad position(s) lying across the brochure's front side prior to separation, thereby establishing after separation an "at a glance" landscape view and categorical notion as to the aftermarket envelope's likely contents.

These objectives are achieved in accordance with the present invention by provision of a rectangular sheet of paper or the like material comprising a plurality of severable advertising panel bodies which are interconnected and folded in a manner perpendicular to the long horizontal axis of the rectangular sheet generally through the application of paired groups of scorelines. Also, attached as an expanded variation at random vertex fold points established by the groups of scorelines, are preassembled leaflet(s) attached by means of a release adhesive.

Likewise, at either or both ends of the aforementioned sheet, a severable reusable envelope is constructed from the actual end panels of the sheet, finished envelope(s) and interconnected ad panel bodies inclusive, then create balanced interconnected component portions of uniform size when folded.

Further objectives and advantages of the invention will become apparent from a consideration of the drawings and ensuing descriptions.

BRIEF DESCRIPTION OF THE DRAWINGS

The foregoing features, advantages, and other objects of the invention will become clearly understood from the following descriptions taken in conjuction with their accompanying drawings and figure identification.

REFERENCE NUMERALS IN DRAWINGS

Figure 1:
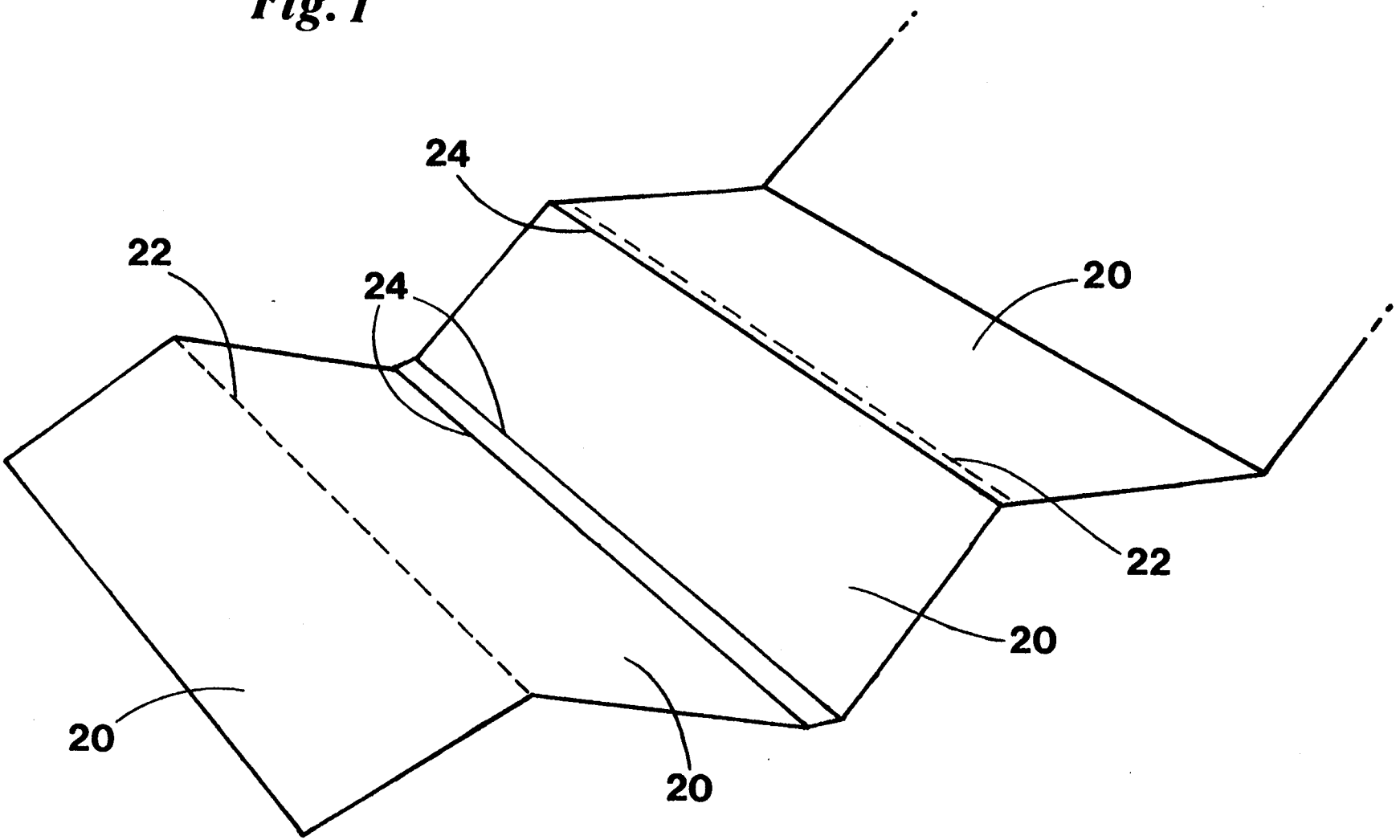
FIG. 1 Illustrates the interconnected ad panel basis and a typical folding means.

20—Ad Panels
22—Perforation Lines
24—Grouped Parallel Scorelines
26A—Basic Preassembled Leaflet—Closed Position
26B—Basic Preassembled Leaflet—Open Position
28—Categorical Title Strip
30—Adhesive/Release Type Glue
32—Envelope Panel(s)
34—Opposing Scorelines/Accordion Expansion Enablement
36—Envelope Assembly Tabs
38A—Tuck-in-tongue Die Cuts (Male)
38B—Tuck-in-tongue Slits (Female)
40—Exemplary Ad Inserts
42—Parallel (landscape) Pictorial Ad Field

DETAILED DESCRIPTION OF THE DRAWINGS

In referring to the drawings as illustrated, it shall be understood that the combined entities of FIGS. 1 thru 13 inclusive, are formed of any suitable material, such as paper, capable of being imprinted with advertising and structural copy, return address, or indicia on all surfaces through the use of modern high speed Web offset or the like production equipment.

Likewise, it will be understood that ad panels 20 shall become interconnected and portioned through the application of either perforation lines 22 or grouped parallel scorelines 24, whereby placed in a manner perpendicular across the long horizontal axis of the rectangular sheet as seen in FIG. 1. If desired however, each ad panel may be of unequal size.

Figure 2:
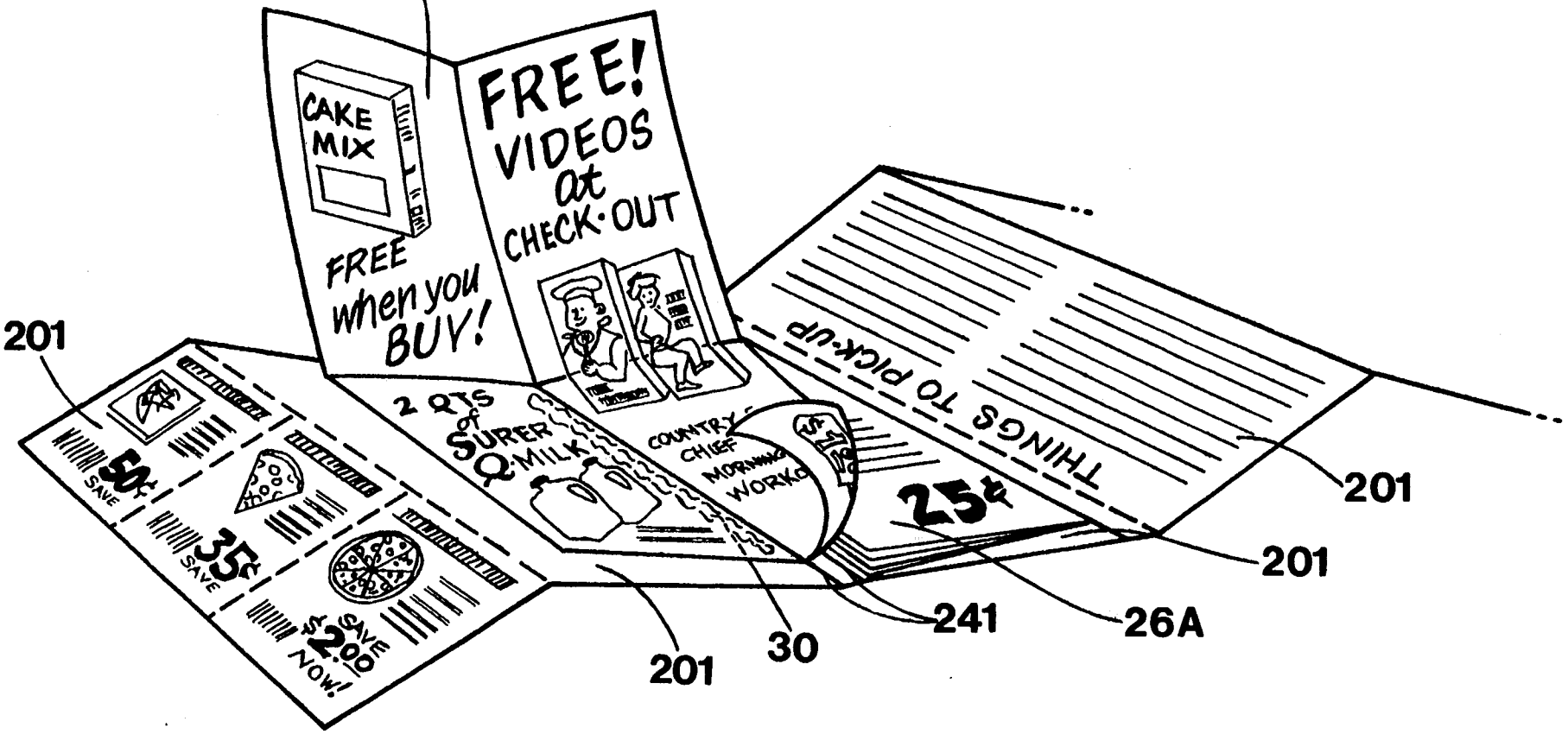
FIG. 2 Illustrates the interconnected brochure ad panels including a variation of basic preassembled leaflet(s) in their attached closed or generally open configurations.

The additional embodiments of FIG. 2 illustrate a basic preassembled leaflet variation assigned to the main body ad panels 201 with 26A showing a leaflet in its closed position. Likewise, 26B demonstrates a leaflet's typically open position; although, it should be noted that the open position shall vary in shapes and sizes, thereby according the additional formative ad space as required and structural basis necessary in order to service a given sponsor's pop-up type promotion. Conversely, the closed position of 26A shall not exceed the size proximity of its mounting ad panel 201. Likewise, leaflets are placed about ad panel(s) 201 and adjoined with a release type adhesive 30. Preassembled leaflets are typically adhered along the grouped parallel scorelines 241 or the like.

Figure 3:
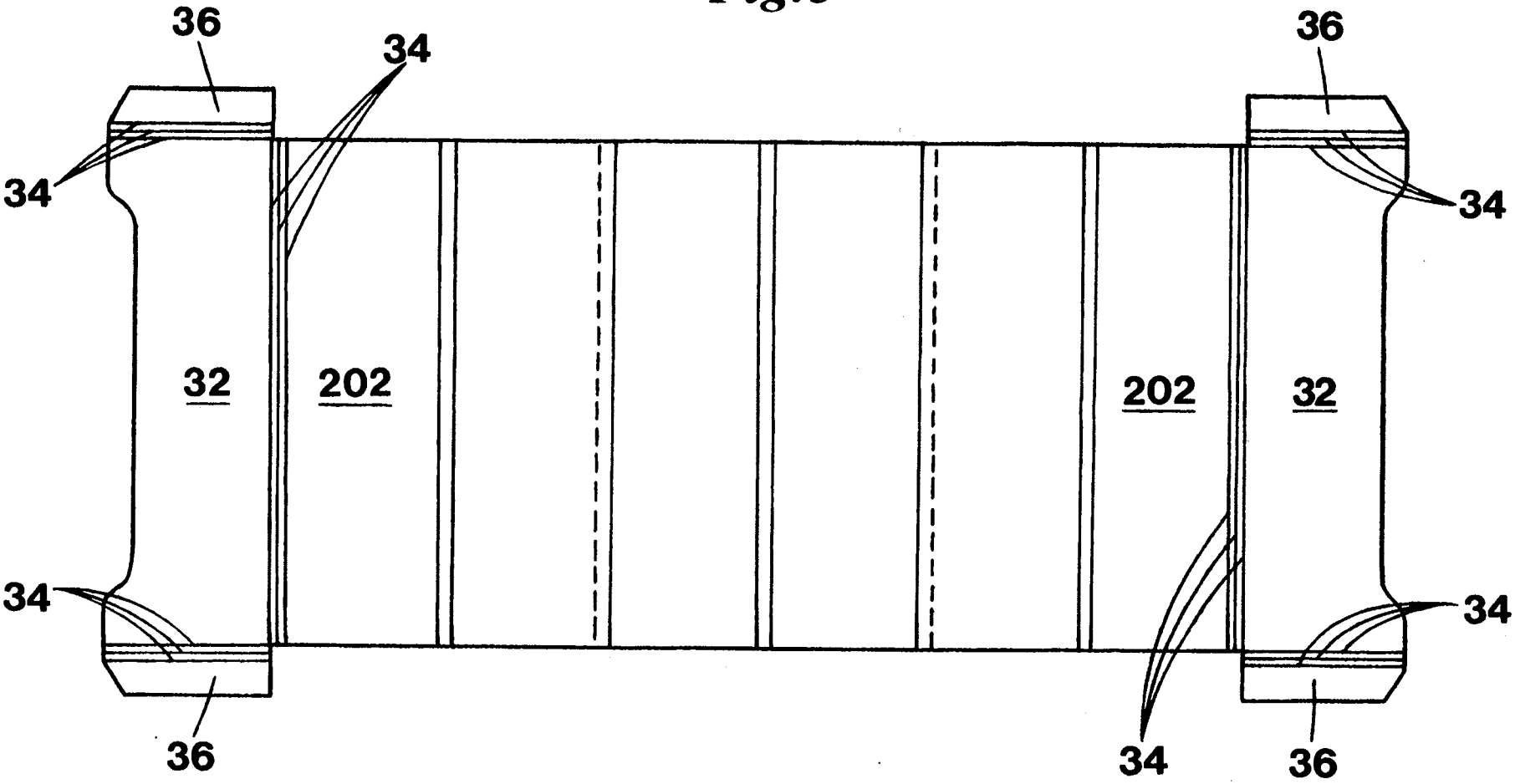
FIG. 3 Illustrates a plan view of a typical ad panel sheet configuration including reusable envelope panel assemblies at both ends.
Figure 4:
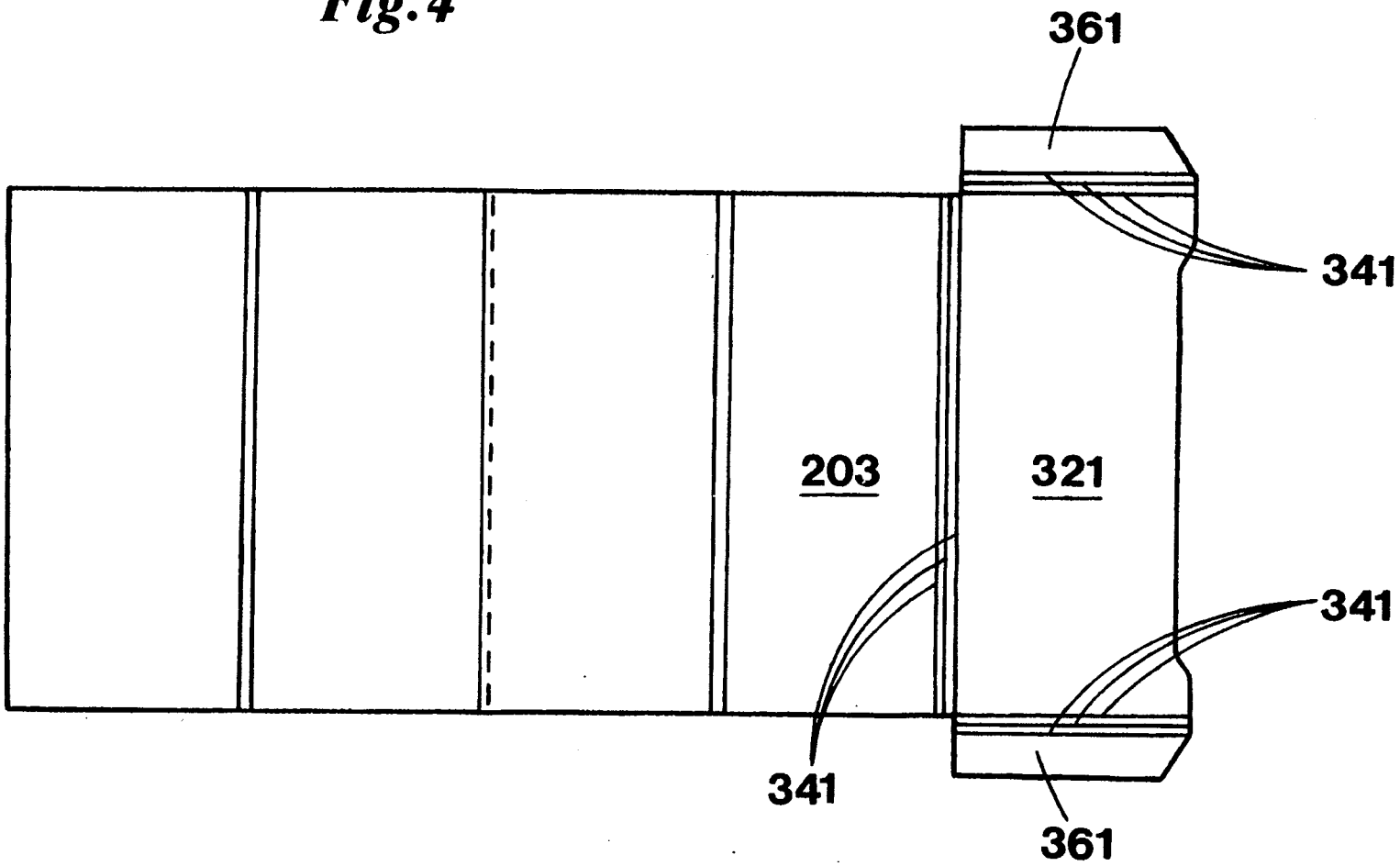
FIG. 4 Illustrates a plan view of a similar ad panel sheet with a single reusable envelope assembly variation.

The plan layout views of FIGS. 3 and 4 illustrate similar interconnected panel configurations as shown in FIGS. 1 and 2, including end envelope panel(s) and components not aforementioned in FIGS. 1 and 2. Also illustrated in FIGS. 3 and 4 is a third opposing scoreline having parallel alignment through the front side center of the given paired groups of scorelines located between the envelope panel(s) 32, 321 and their adjacent interior ad panels 202 and 203 respectively thereby establishing a trio network of parallel yet, opposing scorelines 34 and 341 which act as accordion expansion enablements.

Figure 11:
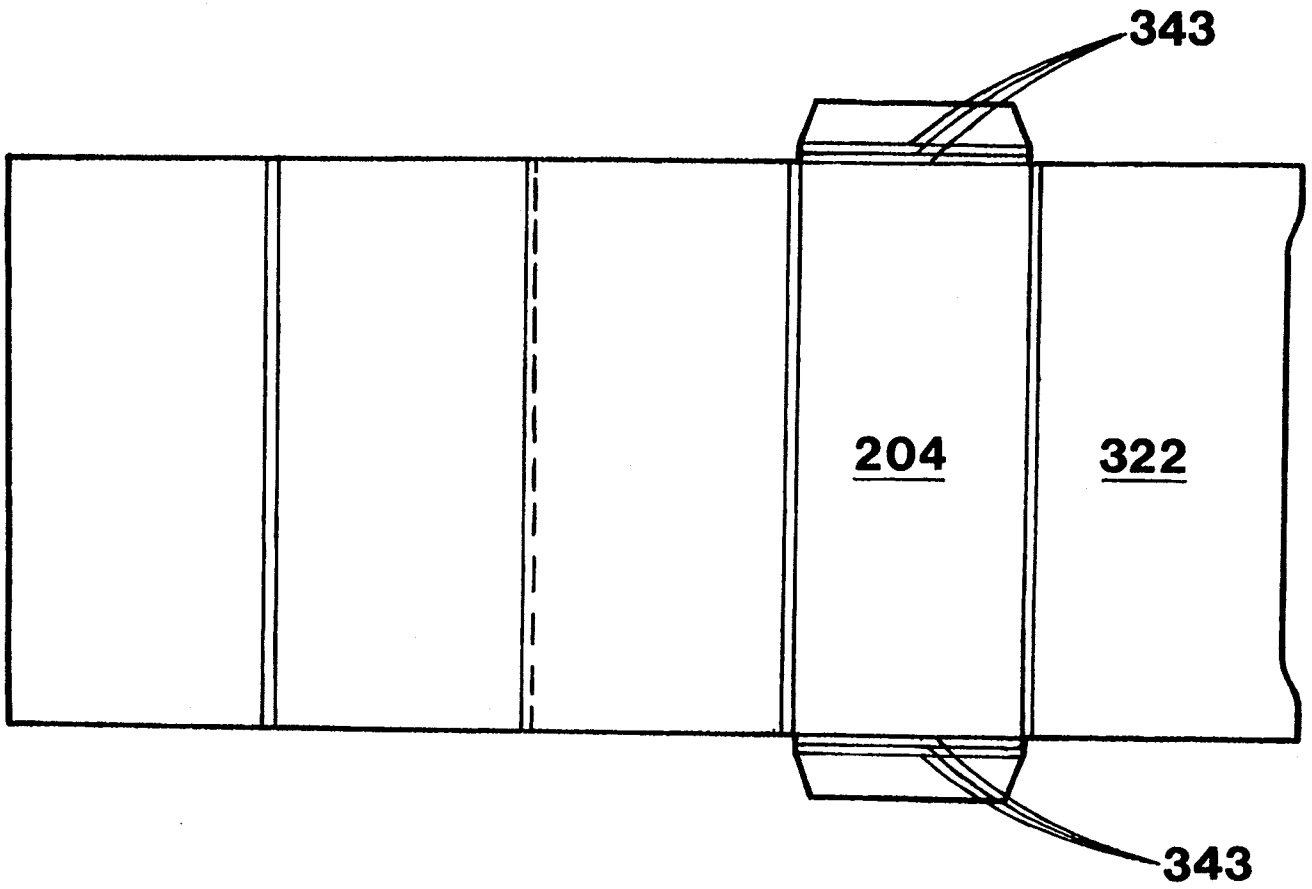
FIG. 11 Illustrates another plan view of an ad panel sheet with a single reusable envelope assembly variation.
Figure 12:
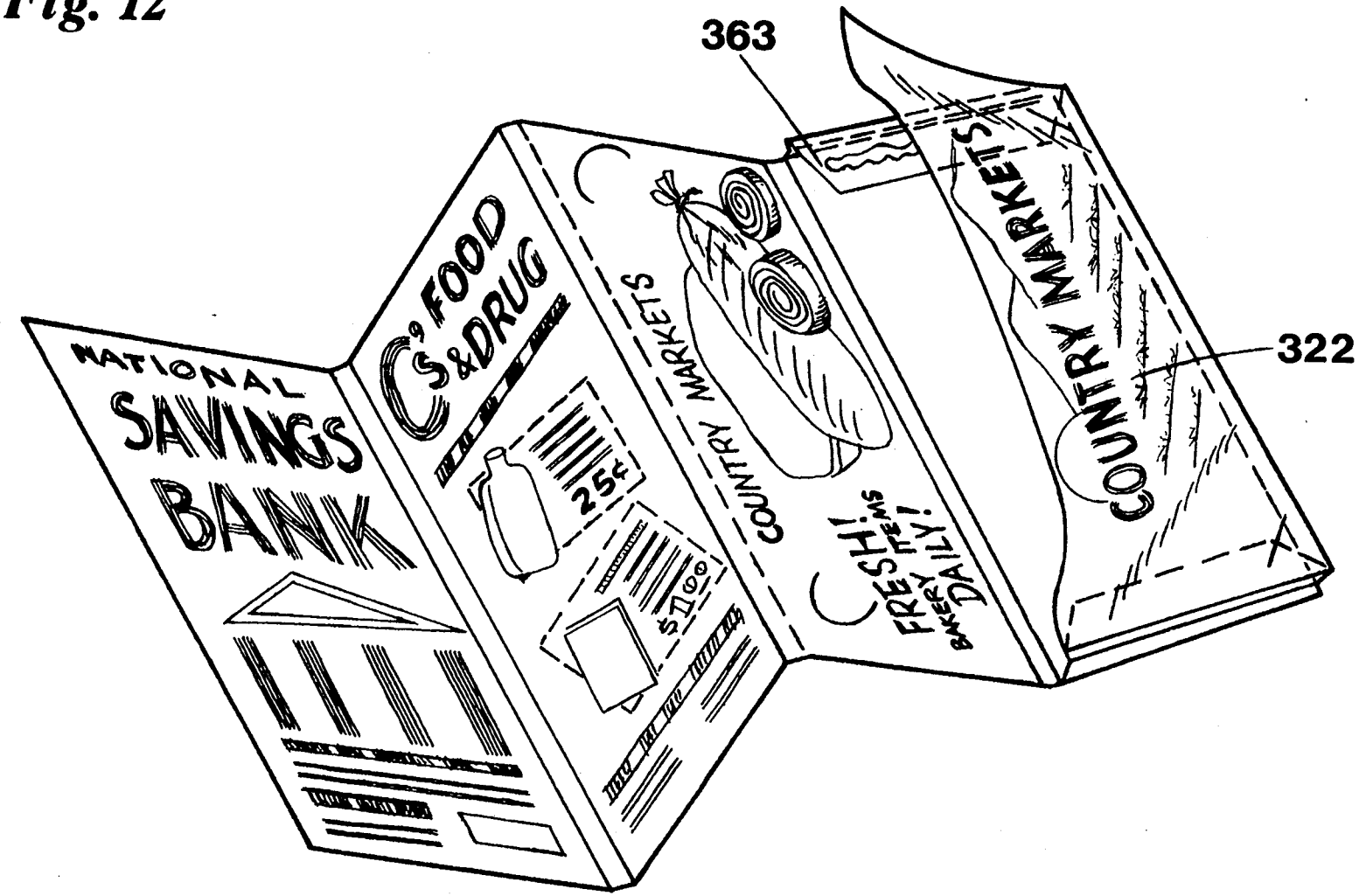
FIG. 12 Illustrates another variation of the affixed positions of the assembly tab segments to their neighboring end envelope panel.

Further illustrated in FIGS. 3 and 4 are the assembly tabs 36 and 361 which combine an adhesive area approximating the peripheral front side edge portion of the tabs with additional trio networks 34 and 341 located between the peripheral adhesive area of assembly tabs 36 or 361 and the two shorter sides of either envelope panel(s) 32 or 321 respectively. Additionally, FIG. 11 illustrates a similar permutation of these components wherein envelope panel 322 lies adjacent to the ad panel 204 having two sets of trio networks 343 that encompass the two shorter of the three perimeter sides of the invention's aftermarket envelope compartment when assembled as shown in FIG. 12.

Figure 5:
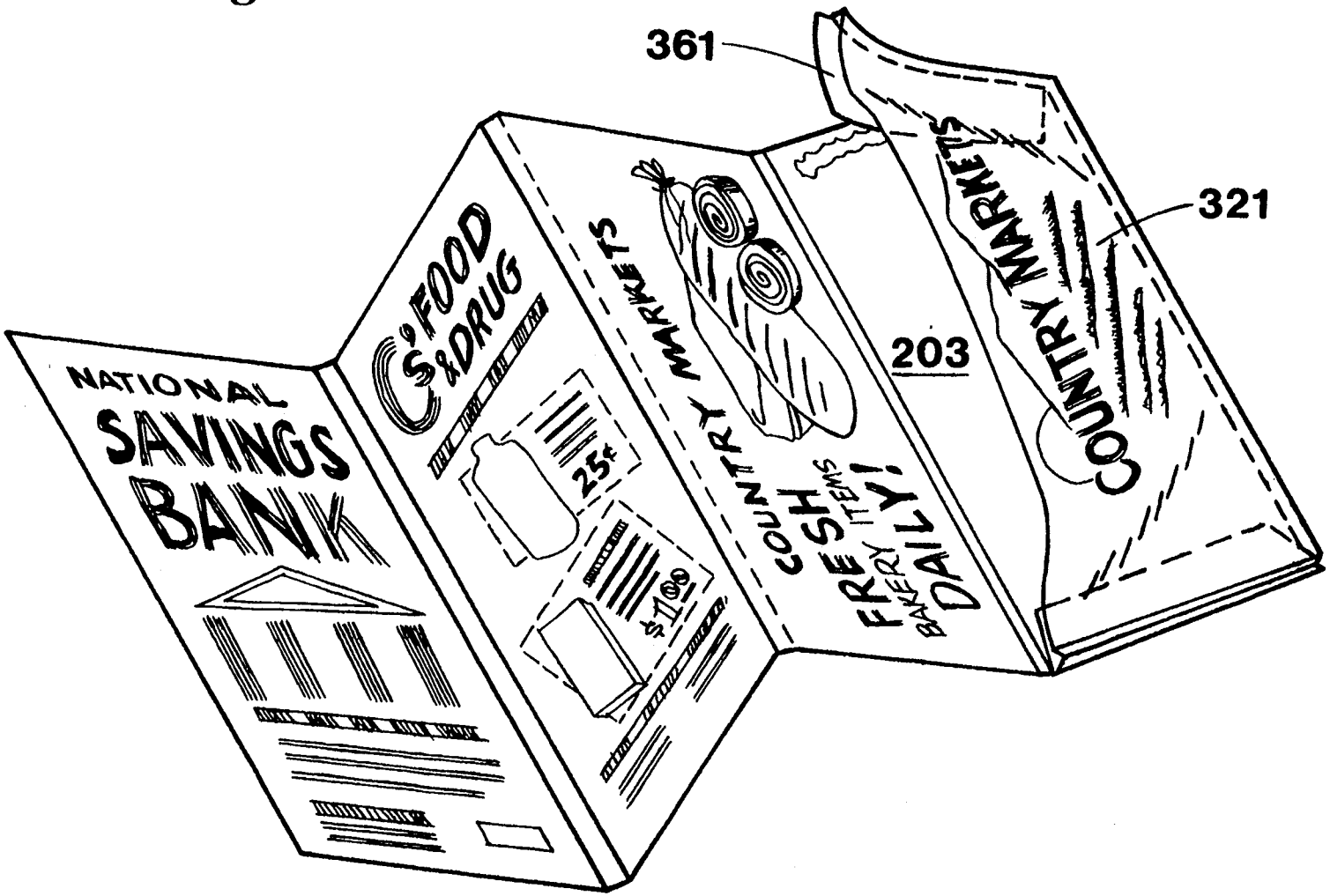
FIG. 5 Illustrates a variation of the affixed positions of the envelope assembly tab segments to their neighboring ad panel.
Figure 6:
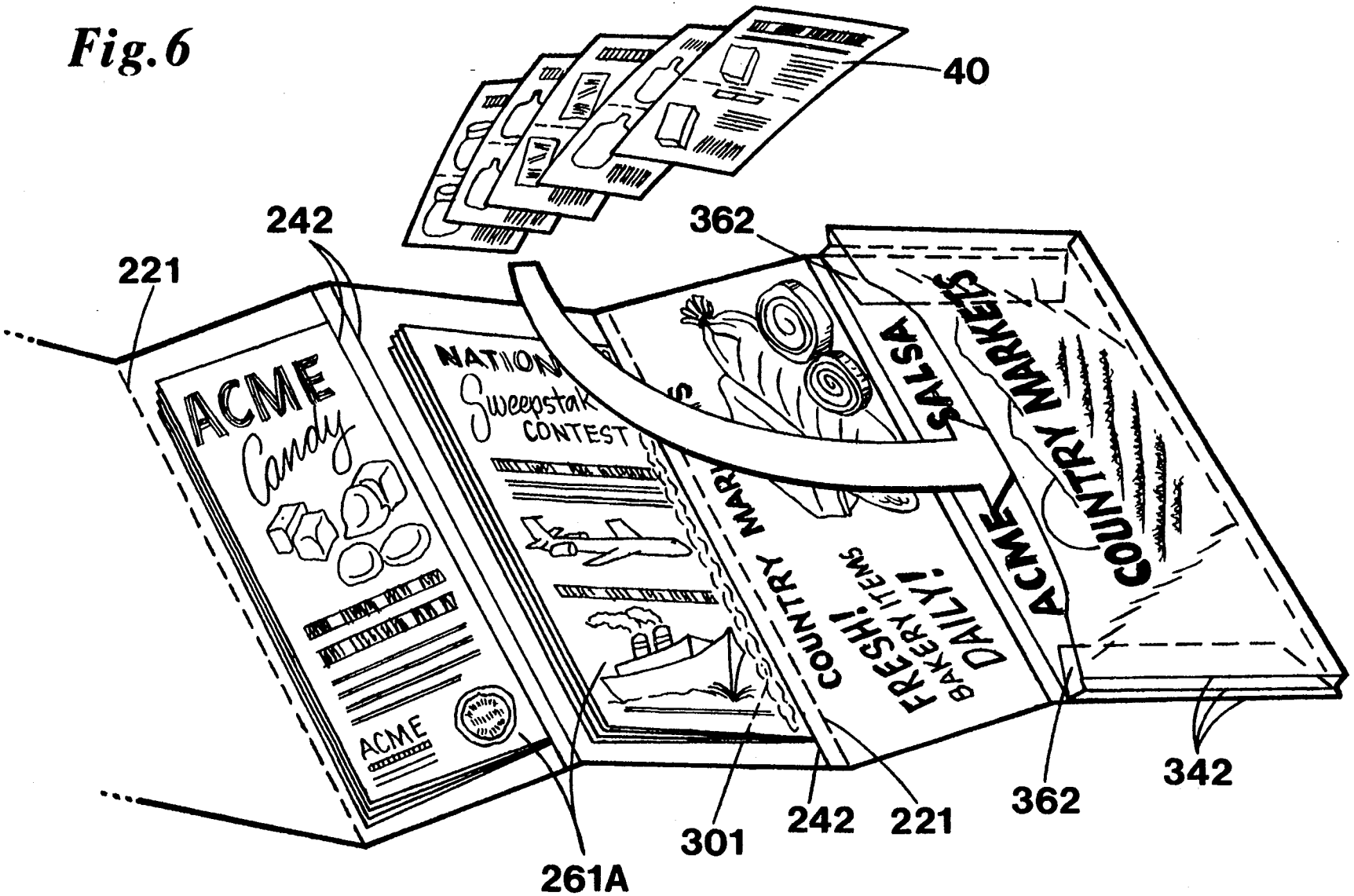
FIG. 6 Illustrates a pictorial view of the preferred brochure embodiment including the positioning of additional advertising insertions for their initial delivery.
Figure 7:
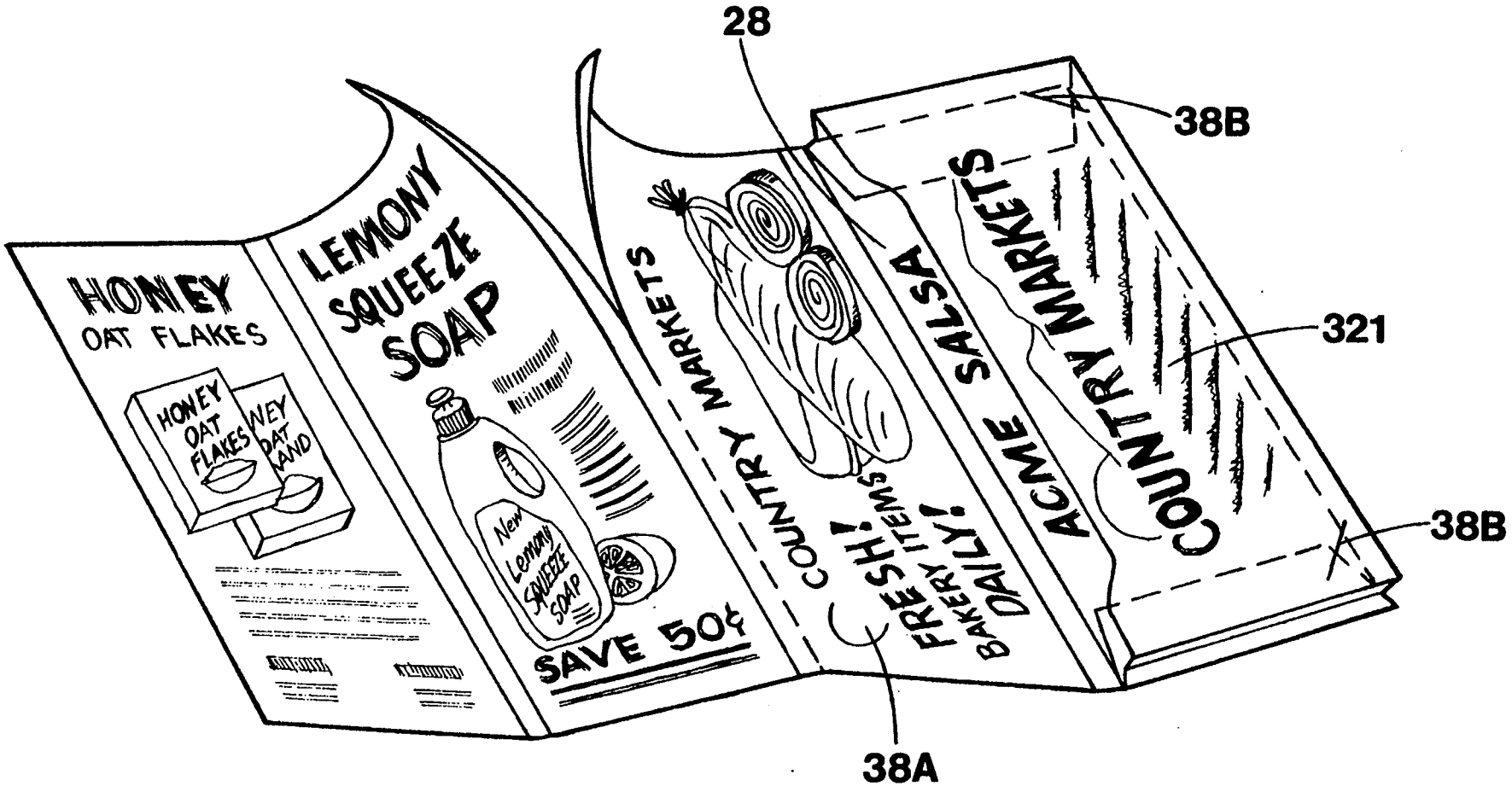
FIG. 7 Illustrates the severance of a reusable aftemarket envelope from the balance of the brochure and also illustrates the categorical title strip area.
Figure 8:
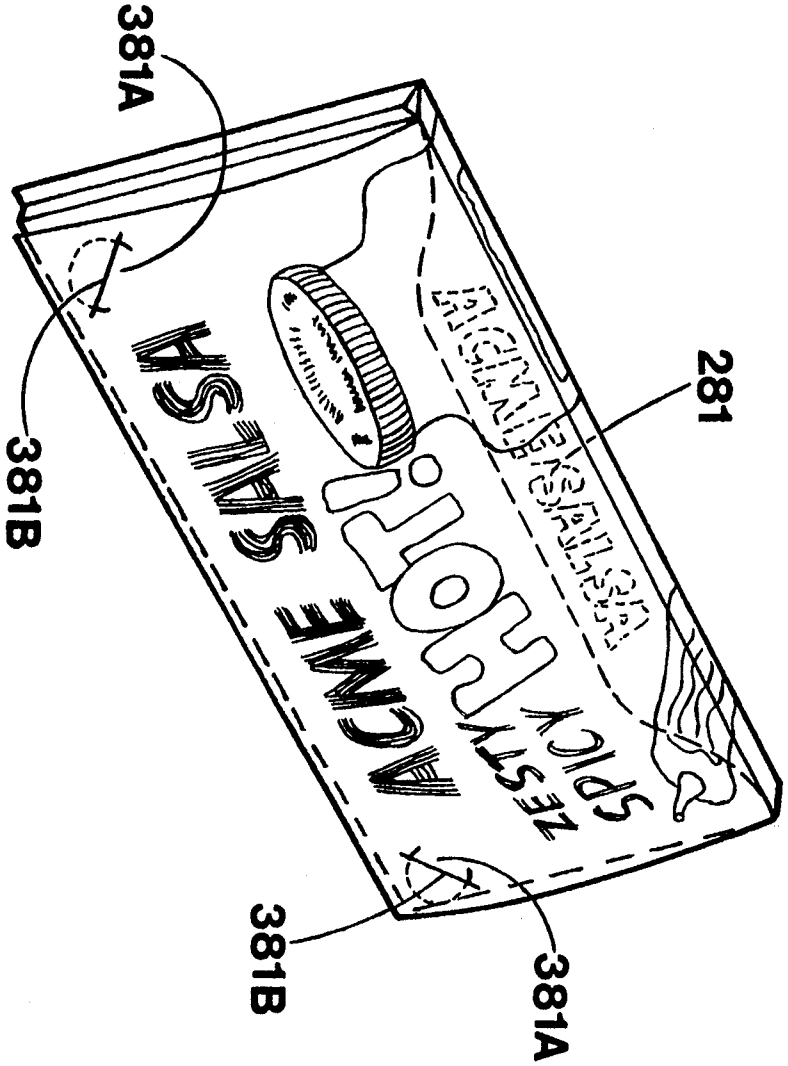
FIG. 8 Illustrates a free standing aftermarket envelope in the closed configuration thru means of the tuck-in tongue closure apparatus.

FIG. 5 demonstrates one configuration of an envelope assembly including the envelope assembly tabs 361 and envelope panel 321 in relation to their adjacent interior underlying mounting ad panel 203. Likewise, FIG. 12 illustrates another alternate configuration for envelope assembly wherein envelope assembly tabs 363 adhesion is to the adjacent exterior overlapping envelope panel 322. In FIG. 6, the assembly tabs 362, as shown, establish the overall accordion expansion action of the trio networks of parallel opposing scorelines 342 to accommodate a multitude of ad insertions 40 as shown in the invention's preferred pictorial embodiment of FIG. 6. Additionally, the preferred embodiment of FIG. 6 illustrates a variety of panel portionings 221 and 242, as well as preassembled leaflets 261A which are attached with a releasable adhesive 301. The pictorial view illustrated in FIG. 7 shows the separation of the main body brochure portion from the reusable envelope's "flap" portion. Included in the corners adjacent the newly separated edge, is the (male) tuck-in tongue die cuts 38A. Furthermore, about envelope panel 321 lies the (female) tuck-in tongue slits 38B, thereby enabling the complete tuck-in tongue 381A and 381B closure of the now independent aftermarket envelope portionment as shown in FIG. 8. Likewise illustrated in FIGS. 7 and 8 is the categorical title strip 28 and 281 located about the envelope's exposed inside back panel portionment whereby, the recipient is able to store desired coupons categorically through either a name brand or generic title classification during an aftermarket envelope's reuse stage.

Figure 9:
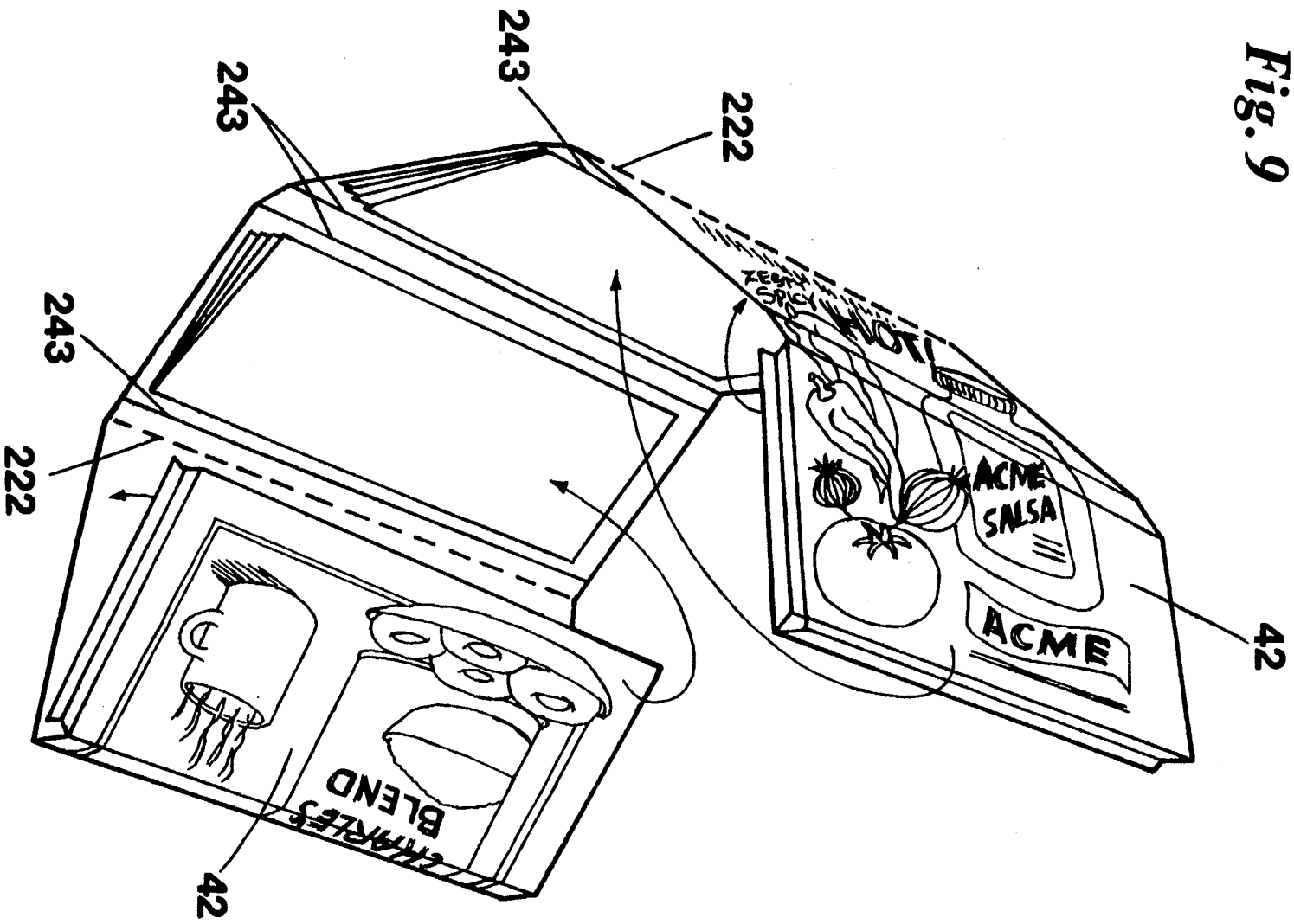
FIG. 9 Demonstrates a folding method for the double envelope brochure and also illustrates the parallel landscape alignment of the pictorial ad field's position prior to separation.
Figure 10:
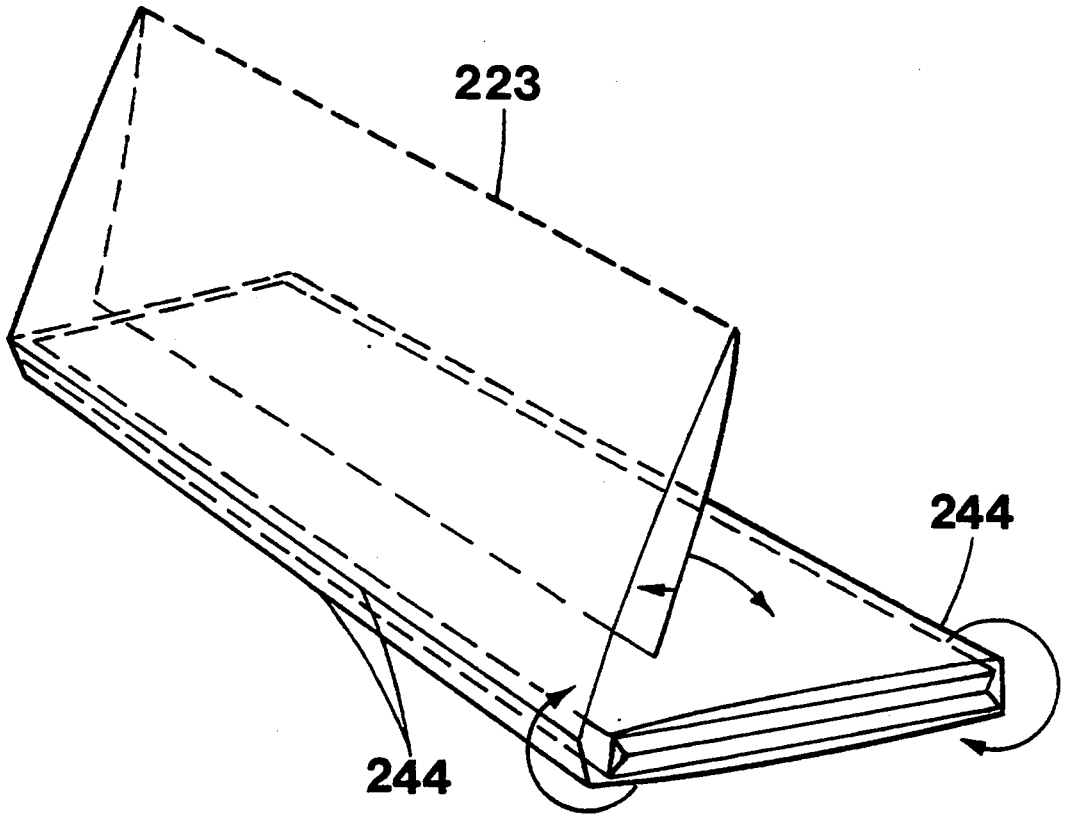
FIG. 10 Demonstrates a folding method for the single envelope brochure device.
Figure 13:
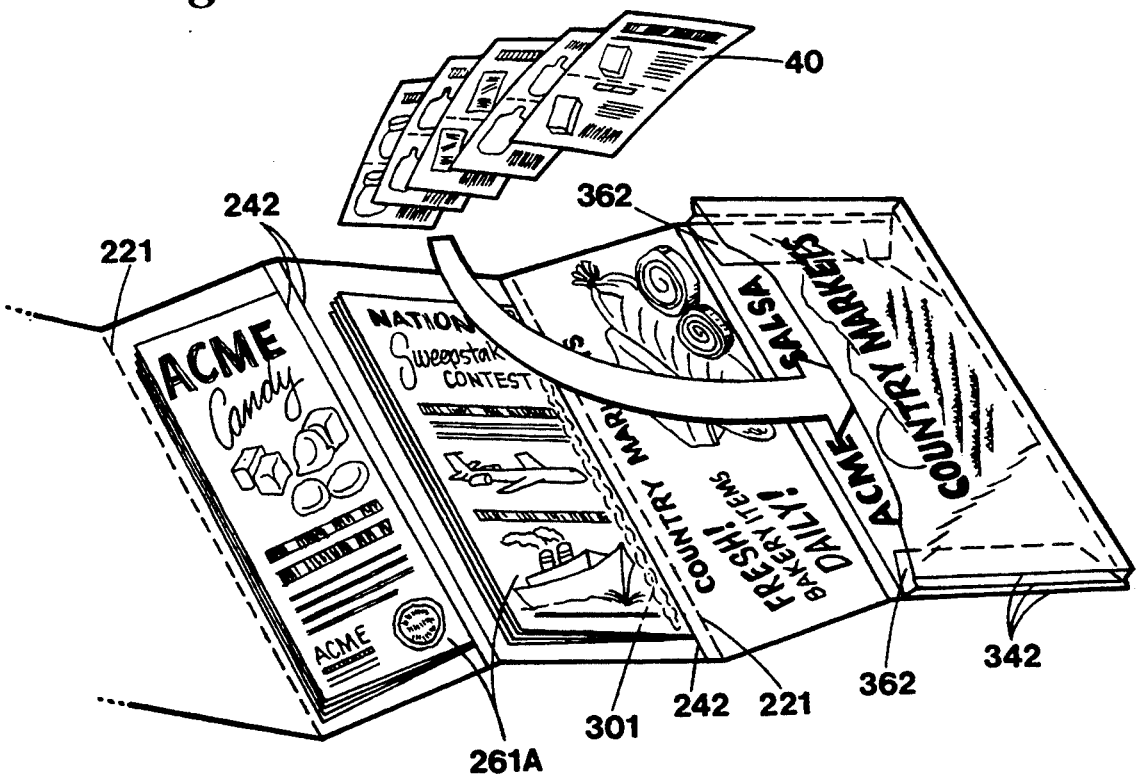
FIG. 13 Illustrates a composite depiction of the promotional advertising brochure both before and after severance of the reusable envelope device.
Figure 13:
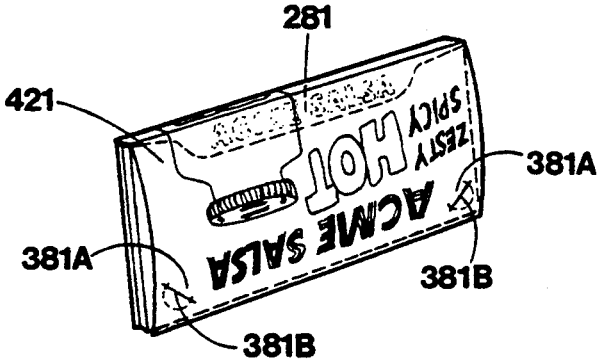

Illustrated in FIGS. 9 and 10 are two preferred methods of folding a version of the invention utilizing multi-roll folds in sequence with perforation lines 222 and 223 or grouped parallel scorelines 243 and 244 respectively, or any combination thereof, wherein interconnected component portions of relative uniform size embody the final profile of the brochure. FIG. 9 also illustrates the parallel alignment of the visually descriptive (landscape) pictorial ad field(s) 42 located thereon the front side of the envelope embodiment(s) prior to separation. While FIG. 13 illustrates the pictorial ad field 421 after separation, which in turn provides an "at a glance" notion as to the aftermarket envelope's most likely contents. Finally, FIG. 13 is a composite illustration of the brochure's preferred embodiment as shown in FIG. 6. Also shown is the preferred aftermarket handling configuration of the brochure's reusable envelope(s) after separation, as previously illustrated in FIG. 8.

OPERATIONAL OBJECTIVES

In considering the final profile of this advertising brochure device, perhaps the very essence and likewise success of the foregoing descriptions and drawings shall become perspicuous through the careful focus of the two prime operational objectives. First, that of efficiently proliferating millions of coupons and like promotions through the deployment of a structurally insightful and captivating vehicle as cumulatively illustrated in the preferred composite configurations shown in FIG. 13. Secondly, to facilitate, for the consumer, an enhanced course of spontaneous organizational discipline thereby benefiting coupon redemption through the utilization of the brochure's structural copy inclusive with the pictorial ad field of the reusable aftermarket envelope embodiment(s), as further illustrated in their free standing forms of FIGS. 7, 8, and 13. Therefore, these objectives characterize the operational intentions of the invention throughout the marketplace. It is then axiomatic that the recipient experiences the natural flow of events, whereby exploiting the contents and organizational attributes of the invention to their advantage and that of the ensuing sponsorship.

While the preferred configuration of the present invention has been described and shown, it will be recognized by those skilled in the art that various modifications may be made thereto without departing from the spirit of the invention. For example, many other variations are possible. The brochure may be formed with reusable envelopes on both ends of the interconnected panel portion bearing any known variation of envelope assembly. And also, having or not having preassembled releasable leaflets which may be of various shapes and sizes. Or, having or not having categorical title strips thereon. Likewise, the aftermarket envelope may have but one tuck-in tongue closure enablement about the flap and underlying panel portionment. And for business reply application, a standard moisture adhering glue may be an alternate closure method. Accordingly, the invention is to be limited only as defined by the appended claims.

I claim:

1. A combined promotional advertising device made of material adapted to be imprinted with advertising and structural copy further incorporating a substantially enhanced organizational formatting means for promoting greater aftermarket flexibility and performance efficiency, comprising a main body; with said main body comprising:

a rectangular sheet of material having a long horizontal axis and having a front side and a reverse side;

said rectangular sheet having at least three folding means for creating at least four vertically adjacent panel bodies across said long horizontal axis of the sheet thereby establishing said main body portionment;

a reusable aftermarket envelope constructed form at least one end of the sheet with said reusable aftermarket envelope being further comprised of an end panel of said rectangular sheet being fixedly adhered to its adjacent interior panel respectively by a securing means;

a severance means being operatively interposed between at least the third and the fourth adjacent panel bodies associating across the said long horizontal axis of the sheet thereby enabling said reusable aftermarket envelope to be separated from said main body portion into a freestanding aftermarket form; and, a pictorial ad field located on the front side panel portion of said reusable aftermarket envelope wherein the ad field is oriented parallel to said long horizontal axis of said rectangular sheet whereby providing a functional at a glance view as to the likely aftermarket contents of the envelope.

2. The promotional advertising device as in claim 1 further comprising a second reusable aftermarket envelope wherein the sheet further comprises at least four folding means and at least five panel bodies and wherein said second reusable aftermarket envelope is formed by folding said rectangular sheet's other end panel to adhere to its adjacent interior panel respectively by a securing means.

3. A combined promotional advertising device bearing a reusable aftermarket envelope adapted to be imprinted with advertising and structural copy further incorporating a substantially enhanced organizational means to promote greater performance of advertising events, comprising a main body; with said main body comprising:

a rectangular sheet of material having a long horizontal axis and having a front side and a reverse side;

said rectangular sheet having at least three folding means for creating at least four vertically adjacent panel bodies across said longitudinal axis of the sheet thereby establishing said main body portionment;

at least one of said panel bodies of said main body portionment having advertising indicia thereon;

a reusable aftermarket envelope constructed from at least one end of the sheet with said reusable aftermarket envelope being further comprised of an end panel of said rectangular sheet being fixedly adhered to its adjacent interior panel respectively by a securing means;

a severance means being operatively interposed between at least the third and the fourth adjacent panel bodies associating across the said long horizontal axis of the sheet thereby enabling said reusable aftermarket envelope to be separated from said main body portion into a freestanding aftermarket form; and, a pictorial ad field located on the front side panel portion of said reusable aftermarket envelope wherein the ad field is oriented parallel to said long horizontal axis of said rectangular sheet whereby providing a functional at a glance view as to the likely aftermarket contents of the envelope.

4. The promotional advertising device as in claim 3 further comprising a second reusable aftermarket envelope wherein the sheet further comprises at least four folding means and at least five panel bodies and wherein said second reusable aftermarket envelope is formed by folding said rectangular sheet's other end panel to adhere to its adjacent interior panel respectively by a securing means.

5. The promotional advertising device of claim 3 further comprising an aftermarket envelope having a categorical title strip area located about the envelope's exposed inside back panel portionment whereby enabling recipients to store coupons categorically during the envelope's severed aftermarket stage.

6. A combined promotional advertising device made of material adapted to be imprinted with advertising and structural copy incorporating a reusable aftermarket envelope and additional releasable leaflet segment variations for promoting a greater deployment performance and aftermarket efficiency of advertising events, comprising a main body; with said main body comprising:

a rectangular sheet of material having a long horizontal axis and having a front side and a reverse side;

said rectangular sheet bearing at least three folding means for creating at least four vertically adjacent panel bodies across said long horizontal axis of the sheet whereby establishing said main body portionment;

at least one of said panel bodies of said main body portionment having advertising indicia thereon;

a reusable aftermarket envelope constructed from at least one end of the sheet with said reusable aftermarket envelope being further comprised of an end panel of said rectangular sheet being fixedly adhered to its adjacent interior panel respectively by a securing means;

a severance means being operatively interposed between at least the third and the fourth adjacent panel bodies associating across the said long horizontal axis of the sheet thereby enabling said reusable aftermarket envelope to be separated from said main body portion into a freestanding aftermarket form; and, a pictorial ad field located on the front side panel portion of said reusable aftermarket envelope wherein the ad field is oriented parallel to said long horizontal axis of said rectangular sheet whereby providing a functional at a glance view as to the likely aftermarket contents of the envelope.

7. The promotional advertising device of claim 6 wherein said at least one of said panel bodies of said main body portionment having advertising indicia thereon with said indicia being oriented in a direction perpendicular to said long horizontal axis of the sheet.

8. The promotional advertising device of claim 6 further comprising at least one additional sheet of material forming a preassembled releasable leaflet segment having also a securing means joining the preassembled leaflet variations to said main body device.

9. The promotional advertising device as in claim 6 further comprising a second reusable aftermarket envelope wherein the sheet further comprises at least four folding means and at least five panel bodies and wherein said second reusable aftermarket envelope is formed by folding said rectangular sheet's other end panel to adhere to its adjacent interior panel respectively by a securing means.

10. The promotional advertising device of claim 6 further comprising an aftermarket envelope having a categorical title strip area located about the envelope's exposed inside back panel portionment whereby enabling recipients to store coupons categorically during the envelope's severed aftermarket stage.

* * * * *

UNITED STATES PATENT AND TRADEMARK OFFICE

CERTIFICATE OF CORRECTION

PATENT NO. : 5,333,909

DATED : August 2, 1994

INVENTOR(S) : J. Richard Hedge, Jr.

It is certified that error appears in the above-indentified patent and that said Letters Patent is hereby corrected as shown below:

On the title page:

Item [60], change"Division of" to --Continuation of--.

Col.1, Line 5,change "Division" to --Continuation--.

COL.1, Line 27, change "roll off the press" to --run of press--.

Col.1, Line 59, 60, delete "certainly explain the invention's absence from the larger stage of".

Col.7, Line 24, change "longitudinal" to --long horizontal--.

Signed and Sealed this

Sixth Day of December, 1994

*Attest:*

*Attesting Officer*

BRUCE LEHMAN

*Commissioner of Patents and Trademarks*